US009313592B2

(12) United States Patent
Poulsen

(10) Patent No.: US 9,313,592 B2
(45) Date of Patent: Apr. 12, 2016

(54) ELECTRONIC DEVICE ADAPTED FOR DETECTING A VEHICLE AUDIO SYSTEM

(71) Applicant: BLACKBERRY LIMITED, Waterloo (CA)

(72) Inventor: Jens Kristian Poulsen, Kitchener (CA)

(73) Assignee: BLACKBERRY LIMITED, Waterloo, Ontario (CA)

( * ) Notice: Subject to any disclaimer, the term of this patent is extended or adjusted under 35 U.S.C. 154(b) by 512 days.

(21) Appl. No.: 13/678,615

(22) Filed: Nov. 16, 2012

(65) Prior Publication Data

US 2014/0140521 A1 May 22, 2014

(51) Int. Cl.
*H04R 29/00* (2006.01)

(52) U.S. Cl.
CPC ..... *H04R 29/00* (2013.01)

(58) Field of Classification Search
CPC .. H04R 29/00; H04R 2499/13; H05K 9/0065; B60R 11/0217
USPC ..... 381/86, 302, 365, 389, 56, 58
See application file for complete search history.

(56) References Cited

U.S. PATENT DOCUMENTS

2001/0053228 A1* 12/2001 Jones ..... G10K 11/1788 381/71.6
2005/0201568 A1* 9/2005 Goyal ..... H04M 1/6058 381/74
2011/0075876 A1* 3/2011 Bucheim ..... H04M 1/04 381/365
2012/0029728 A1* 2/2012 Hirayama ..... B60L 11/1838 701/1
2014/0093103 A1* 4/2014 Breece, III ..... H03F 3/68 381/120

* cited by examiner

*Primary Examiner* — Vivian Chin
*Assistant Examiner* — William A Jerez Lora
(74) *Attorney, Agent, or Firm* — Perry + Currier, Inc.

(57) ABSTRACT

According to some aspects an electronic device adapted to detect whether it is coupled to an audio system. The electronic device includes a pulse generator adapted to generate a pulse on a ground return line of the electronic device, and a detector adapted to observe if a response signal is received by the electronic device corresponding to the pulse. If the response signal is received, the electronic device determined that it is coupled to the audio system.

3 Claims, 3 Drawing Sheets

ELECTRONIC DEVICE ADAPTED FOR DETECTING A VEHICLE AUDIO SYSTEM

FIELD

Embodiments described herein relate to electronic devices, and in particular to electronic devices adapted to detect an audio system, particularly an audio system in a vehicle.

INTRODUCTION

Portable electronic devices have gained widespread use and may provide a variety of functions including audio and video playback, telephonic, electronic text messaging and other application functions.

Portable electronic devices can include several types of devices, including cellular phones, smart phones, personal digital assistants (PDAs), music players, portable televisions or DVD players, tablets and laptop computers. Many of these devices are handheld, that is they are sized and shaped to be held or carried in one or more human hands.

Some portable electronic devices are used to provide audio output to an audio system, such as an audio system in a motor vehicle. For example, audio from music, movies or telephone calls may be routed from the electronic device to an audio system in a motor vehicle by connecting the electronic device to the audio system.

Some motor vehicles allow an electronic device's power supply, such as a rechargeable battery, to be charged during audio output. For example, a charging accessory such as a car charger may be used to charge a battery of an electronic device, to power the electronic device, or both, particularly while the electronic device is being used to play audio through the audio system.

BRIEF DESCRIPTION OF THE DRAWINGS

Embodiments of the present disclosure will now be described, by way of example only, with reference to the attached figures, in which.

DETAILED DESCRIPTION OF SOME EMBODIMENTS

Figure 1:
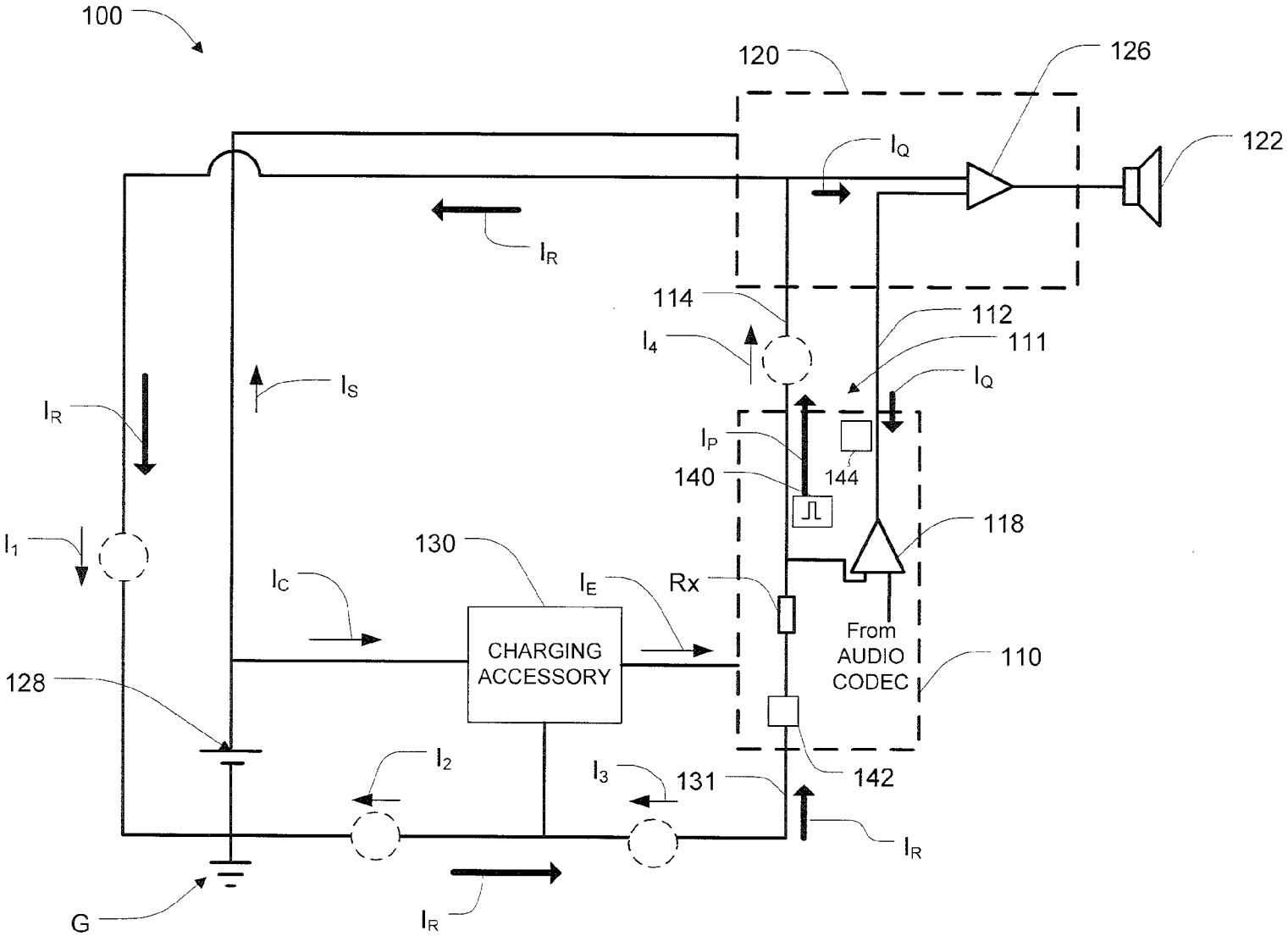
FIG. 1 is a circuit diagram of an audio system coupled to a portable electronic device according to one embodiment.

As introduced above, electronic devices may be adapted to provide audio output (such as music, voice, and so on) through an audio system, such as an audio system in a vehicle.

Generally as used herein, when an element is "adapted to" or "configured to" perform a function, that element is suitable for performing the function, or is operable to perform the function, or is otherwise capable of carrying out that function, in some cases using a particular hardware configuration or software configuration, or some combination thereof.

Some of the teachings herein are directed to a method of detecting whether a portable electronic device is coupled to a vehicle audio system, comprising: generating a pulse using a pulse generator on a ground return line of an audio jack of the electronic device, observing whether a response signal corresponding to the pulse is received by the electronic device at a charging ground line of the electronic device using a detector, and when the response signal is received, then determining that the electronic device is coupled to the audio system, and when no response signal is received, then determining that the electronic device is not coupled to the audio system. The method may include, before generating the pulse, measuring an observed impedance at an audio jack of the electronic device, and generating the pulse only when the observed impedance is within a particular impedance range associated with accessories. The method may further include detecting that the electronic device is coupled to a charging accessory before generating the pulse.

Some of the teachings herein are directed to a method of detecting whether a portable electronic device is coupled to an audio system, comprising: generating a pulse on a ground return line of the electronic device, observing if a response signal is received by the electronic device corresponding to the pulse, and if the response signal is received, then determining that the electronic device is coupled to the audio system. The method may include determining that the electronic device is not coupled to the audio system if no response signal is received. In some embodiments, the response signal is an output current observed on a charging ground line of the electronic device. In some embodiments, the pulse is generated by a pulse generator coupled to the ground return line of the electronic device. In some embodiments, the response signal is observed by a detector coupled to the charging ground line.

The method may include detecting that the electronic device is coupled to a charging accessory before generating the pulse. The method may include detecting that the electronic device is being charged, and then generating a subsequent pulse.

The method may include, before generating the pulse, measuring an observed impedance at an audio jack of the electronic device, and generating the pulse only if the observed impedance is within a particular impedance range. The particular impedance range may be a range associated with accessories.

The method may include, when the observed impedance does not fall within the particular impedance range, then determining that the electronic device is coupled to the audio system.

In some embodiments, the pulse may be a voltage pulse. In some embodiments, the pulse may be a current pulse. In some embodiments, the pulse may be adapted to be inaudible to a human user.

In some embodiments, the electronic device may take one or more actions based on determining whether it is coupled to the audio system.

In some embodiments, the response signal includes a jack response observed on an output line of an audio jack of the electronic device.

The method may include selectively connecting and disconnecting a ground resistor for reducing ground noise.

Some of the teachings herein are directed to an electronic device adapted to detect whether it is coupled to an audio system, comprising: a pulse generator adapted to generate a pulse on a ground return line of the electronic device, and a detector adapted to observe if a response signal is received by the electronic device corresponding to the pulse, wherein if the response signal is received, the electronic device is coupled to the audio system.

The electronic device may determine that it is not coupled to the audio system if no response signal is received. In some embodiments, the response signal may be an output current observed on a charging ground line of the electronic device. In some embodiments, the detector may be coupled to the charging ground line. In some embodiments, the electronic device may detect that it is coupled to a charging accessory before generating the pulse.

In some embodiments, when the electronic device detects that it is being charged, it then generates a subsequent pulse. In some embodiments, before generating the pulse, the electronic device measures an observed impedance at an audio jack of the electronic device, and generates the pulse only if the observed impedance is within a particular impedance range.

In some embodiments, the electronic device may be adapted to provide audio output when the electronic device is a source of audio information. For instance, a portable electronic device may be connected to an audio system in a vehicle using a wired connection, such as an audio jack and plug combination. In some embodiments, the jack and plug can be of the tip-ring-sleeve (TRS) variety, a tip-ring-ring-sleeve (TRRS) variety, or other various types of wired connectors as are known in the art. Some audio connectors are in the form of 3.5 mm (⅛") miniature plugs and jacks, or other sizes such as 2.5 mm connectors and ¼" connectors.

In some cases, an electronic device may be charged using a charging accessory while providing audio output to the audio system. For purposes of illustration, charging will be described in terms of supplying power to a rechargeable battery via a charging accessory. This power may be used to power the electronic device, charge the battery, or some combination thereof. In some embodiments, the charging accessory may be coupled to a DC power supply in the vehicle (e.g., a power supply as defined in the ANSI/SAE J563 specification, also referred to as a "cigarette lighter" power supply).

When an electronic device is connected to an audio system during charging, ground loop currents due to charging and other system components can cause noise problems that result in a low signal-to-noise ratio (SNR). This often results in a poor audio experience. Ground potential may be, but need not be, earth potential, and the discussion of ground does not necessarily imply a current path to earth.

In particular, ground currents through the portable electronic device and the audio jack connection tend to generate a differential voltage that is proportional to the charging current applied to the electronic device. This differential voltage can create a significant amount of audio noise (also referred to as "ground noise" or "charging ground current noise") that interferes with the quality of the audio output, and in some cases may render the audio output undecipherable. The reduction in audio quality can be unsatisfactory and undesirable to a user, particularly when the user is trying to listen to music or participate in a telephone call through an audio system while charging the electronic device.

As described in U.S. patent application Ser. No. 13/088,492 to Poulsen et al., it may be possible to address at least some ground noise issues by monitoring the switching and ground reference used during audio output.

Some audio systems present another challenge. In particular, portable electronic devices may have difficulty determining whether they are coupled to certain types of audio systems depending on the operating characteristics of those audio systems.

In many vehicles, the impedance of the audio system falls outside of the range of impedances normally associated with audio accessories (e.g., headphones or headsets). For instance, the impedance of many vehicle audio systems is significantly larger (e.g., around 47 kOhm) than the impedances of audio accessories, which often have an impedance of less than around 3 kOhm. In such cases, an electronic device can determine whether it is coupled to an audio accessory or to a vehicle audio system by measuring the observed impedance.

Specifically, if the observed impedance is within a range associated with accessories (e.g., between about 32 Ohm and 3 kOhm), then the electronic device can determine that it is coupled to an accessory. Conversely, if the electronic device observes an impedance outside of the particular range (e.g., greater than 3 kOhm), the electronic device can determine that it is coupled to an audio system.

In some embodiments, the electronic device may then take one or more actions based on this determination. For example, when the electronic device detects that it is coupled to an audio system, it can output a LINE OUT signal, bypassing local volume controls to allow audio volume to be controlled by the audio system (e.g., using a master volume control of the audio system).

Conversely, when the electronic device detects that it is connected to a headset or other accessory, the electronic device can control the outputted audio volume using the volume controls on the electronic device.

Unfortunately, some audio systems have impedance values that fall within the range of impedances commonly associated with headphones and other accessories. In particular, some vehicles have audio systems with an impedance of between 1 kOhm and 3 kOhm, which is within the range normally associated with accessories (for example, in some cases between 32 Ohm and 3 kOhm).

In such cases, the electronic device will be unable to distinguish an audio system from an accessory using impedance measurement. The electronic device may therefore be unable to determine what type of device it has been coupled to, and thus be unable to automatically adjust the audio signal accordingly. This can lead to an undesirable user experience.

In particular, when an electronic device is unable to determine whether it is coupled to an accessory or an audio system, the electronic device may not output a LINE OUT signal. The volume controls on the electronic device may thus remain active even when the electronic device is coupled to an audio system. This can cause a reduced volume or quality (or both) of audio signals sent to a vehicle audio system, for example when the volume controls on the electronic device are set to a low value. As a result, the audio system will tend to output audio at a lower volume, which may be undesirable.

In some cases a user may try to compensate for the lower audio volume by increasing the master volume of the audio system (e.g., turning the master volume of the audio system to a higher value). However, this may introduce distortion or other undesirable audio effects, particularly at very high values.

Furthermore, when a user subsequently switches from the electronic device to a different audio source (e.g., a compact disc, radio, etc.), that different audio source will often have a louder audio volume that will then be amplified by the audio system. This can result in a sudden increase or "spike" in the volume of audio being output by the audio system, which is undesirable.

This may occur when an electronic device is disconnected from the audio system (e.g., by unplugging an audio jack) as the audio system automatically switches to another audio source.

At least some of the teachings herein have been developed to try and distinguish an audio system from an accessory, particularly in cases where the impedance of the audio system is within a particular impedance range normally associated with an accessory.

When an electronic device is coupled to an audio system and is being charged, the audio system often has a ground connection that is common between the charger and the audio jack. According to some embodiments, an electronic device may be adapted to detect the presence of a common ground and use this information to determine if the electronic device is coupled to an audio system.

In some embodiments, the electronic device is adapted to generate a pulse on a ground return line of an audio jack. For example, depending on the particular configuration of the audio jack, a pulse can be applied to the SLEEVE, to the RING2 terminal if present or to both RING2 and SLEEVE in a TRRS jack.

In some cases the pulse may be a voltage pulse. In other cases, the pulse may be a current pulse.

In some embodiments, a voltage pulse may be helpful to assess the impact on the audio output, since the magnitude of the voltage pulse can be compared to a full scale voltage pulse, which is typically $0.3V_{RMS}$ or $1.2V_{RMS}$.

When using a current pulse, the magnitude of the pulse (measured in Volts) would tend to increase for loads with higher impedance, which may not be desirable. However, one advantage of using a current pulse is that the measured voltage drop is normally linear with the load impedance.

In some embodiments, the pulse may be shaped so as to generally be inaudible to a human user while the test is being conducted. For example, the pulse may be high pass filtered outside the human hearing range in order to be inaudible.

In some embodiments, another way to make the detection inaudible is to tri-state the output amplifier while the ground detection pulse is being applied. In this case, the current detection pulse may work quite well, since this would work with very low ground impedances and naturally limit the current to safe levels.

Once the pulse has been sent, the electronic device can detect the presence or absence of a response signal that corresponds to the pulse. In particular, if there is a common ground between the audio jack and a charger, an increase in output current should be observed in response to the pulse (as compared to the case where there is no common ground).

Whether a response signal is received or not may convey some useful information. If a response signal is observed, this is evidence of a common ground between the audio jack and the charger, indicating that the electronic device is connected to an audio system, and not to an accessory. In other words, when a response signal is received, it may be determined that the electronic device is coupled to the audio system.

Conversely, if no response signal observed, then this suggests that the electronic device may not be connected to the audio system, but may instead be connected to an accessory (although as discussed below this may not be entirely conclusive). In other words, when no response signal is received, then it may be determined—perhaps tentatively—that that the electronic device is not coupled to the audio system.

In some cases, if the charger and audio system do not share a common ground (e.g., as is the case on some BMW vehicles) there will normally be fewer problems with charging noise affecting the audio. However, the initial volume settings may not be optimal.

In some embodiments, the electronic device can take one or more actions based on whether it determines that it is coupled to an accessory or an audio system (e.g., the electronic device may output a signal with a LINE OUT level, etc.)

Figure 3:
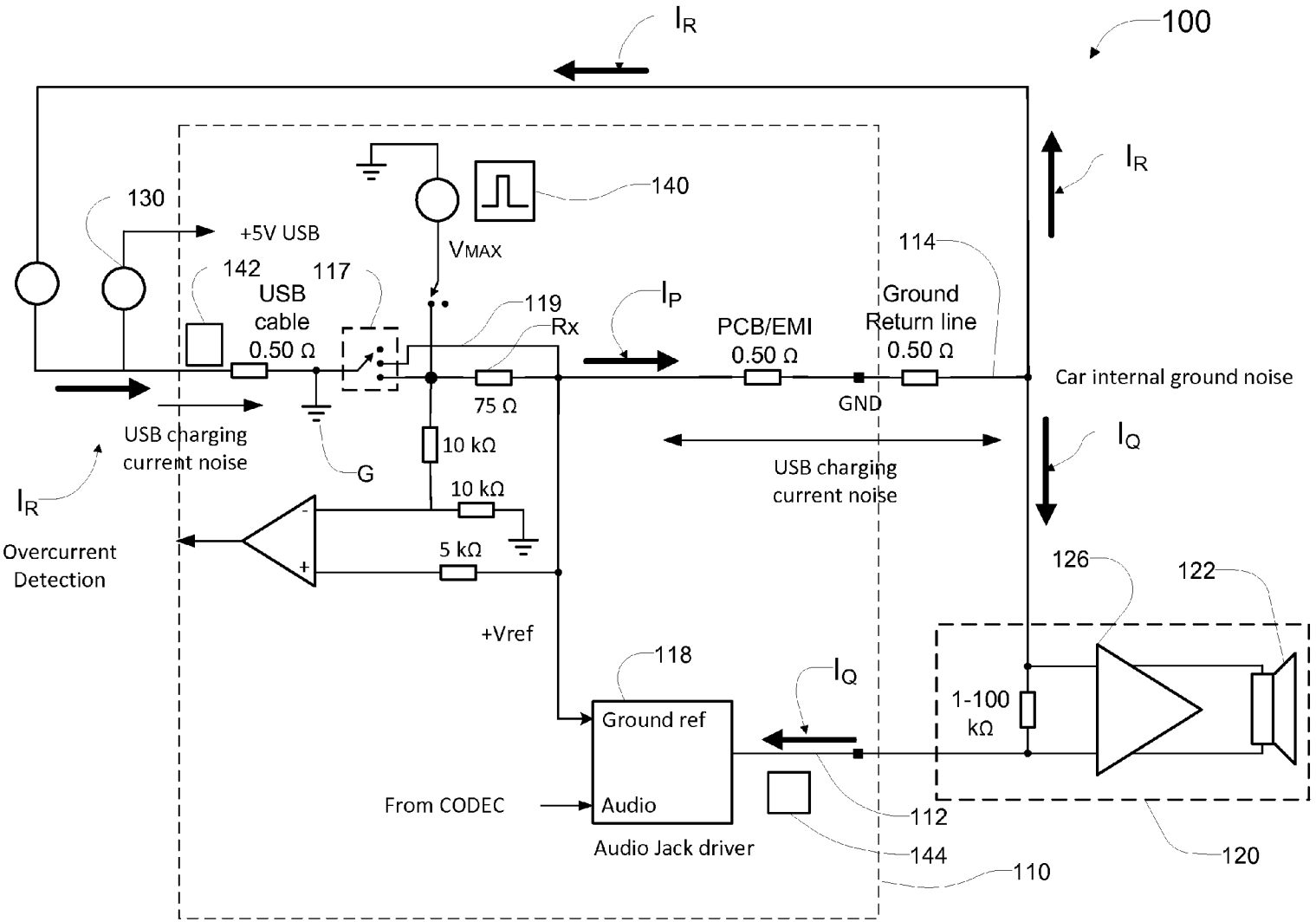
FIG. 3 is a schematic diagram of an audio system coupled to a portable electronic device according to another embodiment.

Turning now to FIGS. 1 and 3, illustrated therein is a system 100 that includes an electronic device 110 coupled to an audio system 120 (e.g., a car stereo in a motor vehicle), and a charging accessory 130 according to one embodiment. The electronic device 110 and the audio system 120 may be coupled (or connected) physically, electronically, optically, communicatively, mechanically or any combination thereof, according to context.

As discussed herein, many of the components that are "coupled" are communicatively coupled and physically coupled as well. In general, components that are "communicatively coupled" are configured to communicate (that is, they are capable of communicating) in any fashion for any duration, such as by way of electric signals, optical signals, wireless signals, or any combination thereof. The communication may be one-way or two-way communication.

Components are "physically coupled" when they are attached or connected or joined to one another, in any fashion, whether releasably or substantially permanently, so that physical activity of one component generally affects the other. The physical attachment may be direct or by way of one or more intermediate elements. Physical coupling may be related to communicative coupling, in that physical coupling may enable one or more current paths by which electrical signals may be transmitted or received.

In this embodiment, only one channel is shown for simplicity, although in practice more than one channel may be used (e.g., a left channel and a right channel). As the context of the description will indicate, the circuitry shown in FIG. 1 may model actual electronic components as well as some physical effects of the interaction of components and parasitic system components such as wiring resistance.

As shown, the electronic device 110 has an audio jack 111 that includes an output line 112 and a ground return line 114. The audio jack 111 is adapted to be coupled to the audio system 120 (e.g., using a TRS or TRRS connector, or another suitable connector) to send audio signals to the audio system 120.

The audio system 120 includes one or more speakers, for example speaker 122 as shown, which may be coupled to an amplifier 126. In some embodiments, the audio system 120 may include only one speaker. In other embodiments, the audio system 120 could include two or more speakers.

In some embodiments, more than one amplifier 126 may be used to drive separate speakers (e.g., two amplifiers may be used for stereo systems with a left and right channel).

During audio playback, audio signals (e.g., music, speech, etc.) are sent by the electronic device 110 to the audio system 120 via the output line 112. These audio signals are then amplified by the amplifier 126 and output as audible sound via the speaker 122.

As shown, the system 100 also includes the charging accessory 130. The charging accessory 130 is coupled to a power source 128 (e.g., a DC power supply such as a car battery of a vehicle), which supplies electrical power to the charging accessory 130. For example, the power source 128 may supply a charging current $I_C$ of around 0.5 amps to the charging accessory 130, at a voltage level of around 13.8 volts.

In turn the charging accessory 130 supplies power to the electronic device 110 (e.g., +5 Volts DC at around 1 amp), indicated generally as current $I_E$. This power can power the electronic device 110, charge a battery (not shown) of the electronic device 110, or both.

The power source 128 may also supply power to the audio system 120, for example providing current $I_S$, which in some cases may be around 2-3 amps at around 13.8 volts.

As shown, the electronic device 110, audio system 120, and charging accessory 130 share a common ground point or node (indicated generally as G).

During use, various differential voltages within the system 100 can cause currents to flow (indicated generally as currents $I_1$, $I_2$, $I_3$, and $I_4$). These currents $I_1$, $I_2$, $I_3$, and $I_4$ may be sources of ground noise that interfere with audio quality.

As shown, in some embodiments the electronic device 110 may include a ground resistor Rx between the ground return line 114 and the ground point G. The ground resistor Rx may help reduce the effects of ground noise, for example by reducing a ground current $I_4$ caused by the charging current $I_E$.

In some cases, the resistance value of the ground resistor Rx may be selected so as to reduce the impact of the ground current $I_4$ without significantly affecting the volume and quality of the outputted audio.

Generally, as long as there is still enough headroom in the output signal, no clipping will occur when using the ground resistor Rx. However, if the ground resistor Rx is included in the signal path and low impedance loads are being driven, this may significantly reduce the headroom and thereby the maximum output level possible.

Therefore, the ground resistor Rx should be included when needed to reduce noise, in which case the loads will always be fairly large, such that no significant reduction in headroom should occur.

Furthermore, the inclusion of the ground resistor Rx may significantly degrade the crosstalk performance, unless ground sense after resistor Rx is used, as shown in FIG. 1. In addition to this, the efficiency of the output may be very low if the ground resistor Rx was included for low impedance loads.

In some embodiments it may be beneficial to disconnect the ground resistor Rx, for example when compensating for ground noise is not desired (for instance when there is little or no ground noise because the electronic device 110 is not being charged) or when the resistance of the ground resistor Rx might significantly affect the audio quality (e.g., when the electronic device 110 is coupled to headphones or an audio system with low impedance and the headroom would significantly decrease).

Figure 2:
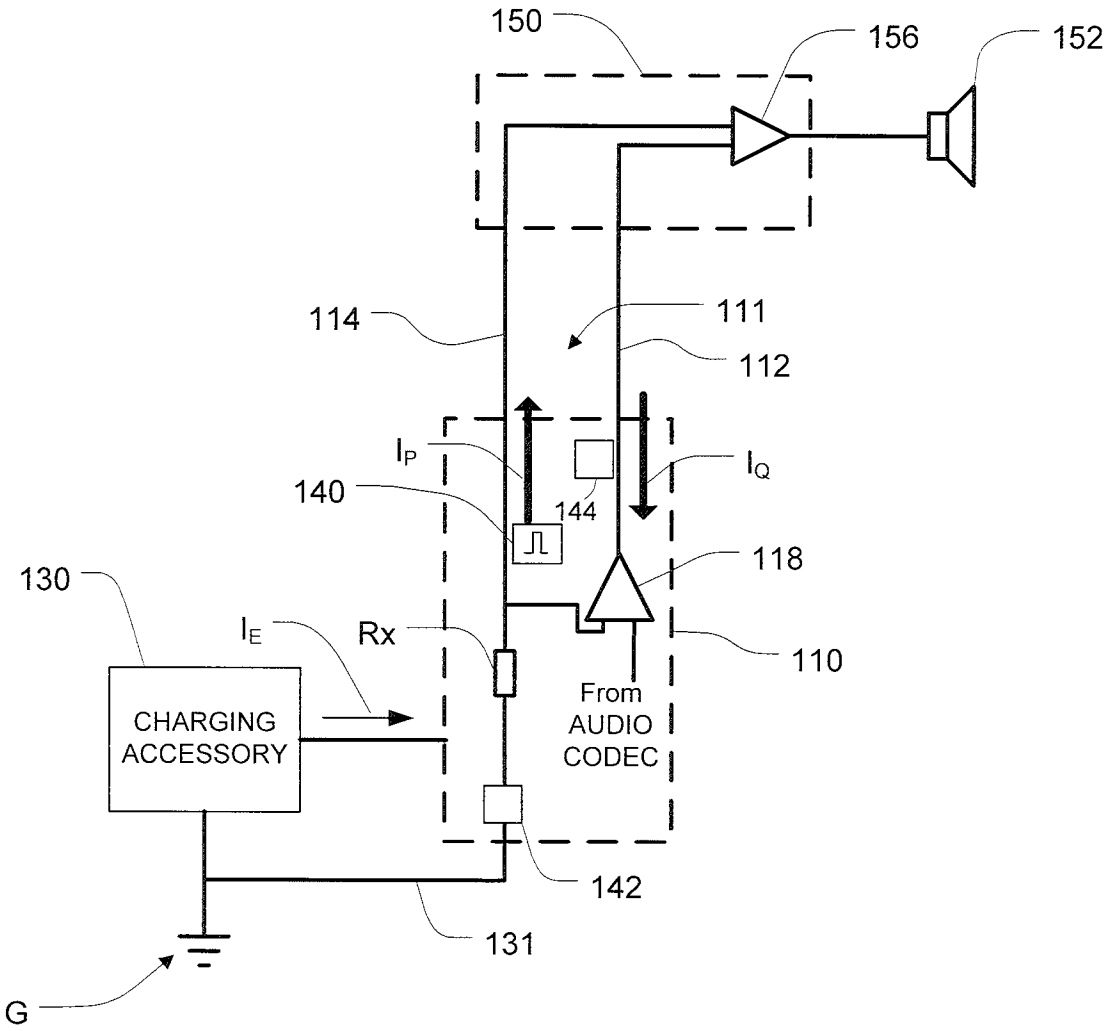
FIG. 2 is a circuit diagram of the portable electronic device of FIG. 1 coupled to an accessory.

As discussed above, the electronic device 110 may be adapted to detect whether the electronic device 110 is coupled to the audio system 120 or coupled to an accessory (e.g., accessory 150 as shown in FIG. 2). In some cases, this may be done by monitoring the input impedance detected by the electronic device 110 through the audio jack 111.

However, as also discussed above, when the audio system 120 has an impedance that is within a particular range normally associated with accessories, the electronic device 110 may be unable to distinguish the audio system 120 from an accessory.

Accordingly, the electronic device 110 may be adapted to detect the presence of the audio system 120 using other techniques. In particular, the electronic device 110 may be configured to detect a common ground (e.g., ground G) between the audio jack 111 and the charging accessory 130.

In some embodiments, the electronic device 110 may be adapted to generate a pulse $I_p$ on the ground return line 114 of the audio jack 111. For example, depending on the particular configuration of the audio jack 111, the pulse $I_P$ can be applied to the SLEEVE of a TRS jack, or RING2 and SLEEVE in a TRRS jack. As shown, the pulse $I_P$ could be generated by a pulse generator 140.

In some embodiments, the pulse $I_P$ may be a voltage pulse, which could for example be generated by a voltage source. In some embodiments, the pulse $I_P$ may have a voltage value of between about −5 Volts to +5 Volts.

In some embodiments, to get good discrimination against noise, a voltage level in the range 50-100 mV could be used. However, a larger voltage value should provide additional protection against noise. It might also be helpful to limit the output current (e.g., by finite output impedance, e.g. 75 Ohm) to avoid large over currents when the ground impedance is very low (e.g., below 1 Ohm).

In some embodiments, the pulse 1p may be a current pulse, which could, for example, be generated by a current source. In some embodiments, the pulse $I_F$ may have a current of between about 0.1 milliAmps to 300 milliAmps.

In some embodiments, a current in the range 1-10 mA would be good to get a good signal-to-noise ratio and discriminate against noise. The current pulse naturally limits the output current to safe levels.

For both for the voltage and current pulse, it may be beneficial to disable the output amplifier while the measurement is being performed in order to avoid large click and pops in the connected speakers during the measurements. However, one disadvantage of tri-stating the headphone amplifier 118 is that this would result in a short interruption in any audio playback.

In some embodiments, the pulse could be spectrally shaped in order to be generally inaudible. Such a shaped pulse could be used to play audio while at the same time performing the measurements. This is beneficial in that audio would not be interrupted if the electronic device was connected to a charger after audio playback had begun. However, one disadvantage is that the associated circuits might become more complicated to implement.

The electronic device 110 can then detect the presence or absence of a response signal $I_R$ corresponding to the pulse $I_P$. In particular, if there is a common ground G between the audio jack 111 and the charging accessory 130, then a relatively large output current response signal $I_R$ should be observed in response to the pulse $I_R$. (e.g., due to the effective "short" between the audio jack 111 and the ground G).

As shown, in this embodiment the response signal $I_R$ is monitored by a detector 142 on the electronic device 110 that is coupled to a charging ground line 131. Alternatively, the voltage drop across the resistor Rx may simply be monitored as an indication on the current going through the open or closed loop as shown in FIG. 3.

If a response signal $I_R$ is observed corresponding to the pulse $I_P$ this is evidence of a common ground G between the audio jack 111 and the charging accessory 130. Based on this information, the electronic device 110 can determine that it is connected to the audio system 120, and not to an accessory.

On the other hand, if no corresponding response signal $I_R$ is observed (e.g., in some cases as determined using a fixed integration period, for example 0.02-10 milliseconds), then the electronic device 110 can determine that it may not be connected to the audio system 120, but may instead be connected to an accessory 150.

As mentioned earlier, some vehicle audio systems do not have a common ground and thus do not have charging noise problems. Therefore, even if the electronic device does not know whether it is connected to such an audio system (i.e. when the electronic device detects no common ground and measures an impedance in a range normally associated with accessories, e.g. 1-3 kOhm) then the audio performance will normally not suffer from charging noise (although the volume setting may not be optimal).

As shown in FIG. 2, the electronic device 110 may be coupled to an accessory 150 (e.g., a headset) and not the audio system 120 of FIG. 1. Similar to the audio system 120, the accessory 150 may include one or more speakers, for example speaker 152, and which may be coupled to an amplifier 156. The accessory 150 may also include a microphone, one or more controls or buttons, and so on. However, as shown the accessory 150 is not coupled to a common ground G with the charging accessory 130.

Thus, when a pulse $I_P$ is generated on the ground return line 114 (e.g., by the pulse generator 140), the detector 142 will not observe a corresponding response signal $I_R$ on the charging ground return line 131. This absence of a response signal $I_R$ can indicate that the electronic device 110 is coupled to the accessory 150 and not to the audio system 120 (although this may not be entirely conclusive in every case, particularly where there is no common ground in a vehicle audio system as discussed above).

If the electronic device 110 is not coupled to the charging accessory 130 when the pulse $I_P$ is generated, then even if the electronic device 110 is coupled to the audio system 120, a response signal $I_R$ may not be observed by the electronic device 110 (e.g., if the charging ground return line 131 has been disconnected from the electronic device 110). In such cases, the audio system 120 may go undetected.

Therefore, in some embodiments the electronic device 110 might make an additional measurement whenever a connection to a charging system is made, to determine the load that has been connected to the electronic device 110.

In some embodiments, a determination may be made first that the electronic device 110 is coupled to a charging accessory 130 before the pulse $I_P$ is generated. This is generally because it is known that there will be no response signal $I_R$ unless the charger 130 closes the ground loop.

In some embodiments, this can be handled by an event driven by the charging circuit inside the electronic device 110. In addition to setting the correct charging characteristics for the battery, the charging circuit may I notify a driver handling the audio section that charging of the electronic device 110 has begun and thus a detection pulse $I_P$ can be sent.

In some other such embodiments, the electronic device 110 may send a pulse $I_P$ even if the presence of the charging accessory 130 cannot be determined. However, subsequently when charging is detected, the electronic device 110 can generate a second (or third, or more) pulse I. If this subsequent pulse $I_P$ indicates the presence of a common ground G, the electronic device 110 may more conclusively determine that it is coupled to an audio system 120.

Depending on whether the electronic device 110 determines it is connected to an accessory (e.g., accessory 150) or an audio system (e.g., audio system 120), the electronic device 110 can take one or more actions. For example, the electronic device 110 can attempt to correct for ground loop problems, bypass the local volume controls and output a LINE OUT signal (e.g., for an audio system 120), change the default equalizer settings, and so on.

As shown in FIG. 3, in some embodiments, the electronic device 110 may activate a ground switch 117 to selectively bypass the ground resistor Rx, for example using a bypass line 119. This may be particularly useful when the electronic device 110 detects that it is coupled to an accessory 150.

In other embodiments, the ground switch 117 may have several positions, so that ground may be either connected to the SLEEVE, RING2 (or both) terminals based on measurements of the impedances of the accessory or audio system that has been connected to the electronic device 110. This can enable support for accessories with multiple different pin configurations (e.g., both TRS and TRRS).

In some embodiments, the ground switch 117 may include a generator (e.g., a voltage, current or charge generator) positioned between the ground terminal and the ground resistor Rx to generate the excitation pulse $I_P$.

In some embodiments, the pulse IP may also generate a jack response IQ that returns to the electronic device 110 via the output line 112. In some cases the jack response $I_Q$ may also be used as a signal to determine whether the electronic device 110 is coupled to the audio system 120 or the accessory 150.

For example, the jack response $I_Q$ may be quite different for the same pulse $I_P$ when the electronic device 110 is coupled to the audio system 120 as compared to when the electronic device 110 is coupled to the accessory 150. In this case, the voltage drop over the ground resistor Rx may be quite small if the load has large impedance. In this case a larger value ground resistor Rx may be used to more accurately determine if the accessory has been connected. Alternatively, a longer detection pulse or a higher detection voltage may be used in order to get a sufficiently good signal-to-noise ratio and determine whether an accessory has actually been connected. In other cases, the jack response current $I_Q$ may be measured by the detector 144 using a series resistor or other device.

When the electronic device 110 is coupled to the accessory 150, the entire current of the pulse I p may return to the electronic device 110 as the jack response $I_Q$ the via the output line 112. Thus, if the magnitude of the current of the pulse IP is generally equal to the magnitude of the current of the jack response IQ, the electronic device 110 can determine that it is connected to the accessory 150.

Conversely, when the electronic device 110 is coupled to the audio system 120 and shares a common ground G, the magnitude of the current of the jack response $I_Q$ will normally be quite small since there is effectively a short to ground. Thus if magnitude of the current of the jack response $I_Q$ is substantially less the magnitude of the current of the pulse $I_P$, then this may indicate that some of the current of the pulse $I_P$ has been siphoned off (e.g., and has gone to the charging accessory 130, for example) and that the electronic device 110 is coupled to an audio system.

In some embodiments, monitoring the current of the jack response $I_Q$ (e.g., using a detector 144) may assist in determining whether the electronic device 110 is coupled to either the accessory 150 or the audio system 120., possibly even when the electronic device 110 is not being charged, although this is generally limited to the range of impedances where there are no known overlaps between the impedances of accessories and of audio system 120.

In some embodiments, the jack response $I_Q$ may be used as a supplementary signal in combination with the response signal $I_R$.

In some embodiments, when the electronic device 110 detects that it is coupled to the audio system 120 and should be in LINE OUT mode, at least some of the controls of the electronic device 110 may be disabled or set to a particular advantageous level (e.g., volume set to near maximum or at maximum and additional boost may be enabled, etc.) and the gain on the electronic device 110 may be set at a particular level so as to provide a relatively clean audio signal (e.g., with minimal or at least reduced distortion) via the output line 112.

In some embodiments, the electronic device 110 may set the default output line 112 volume to a different setting than the default headset volume setting (and which the user may be able to adjust).

In some embodiments, the detection of an audio system 120 may result in specific audio settings (e.g., as selected and programmed by the user in a menu), which may provide for a particularly pleasing beginning to the listening experience.

A typical commercial LINE OUT level is around 316 mVrms full scale, while professional equipment may use larger amplitude such as $1.23V_{RMS}$. This means that when a user connects the electronic device 110 to a line in amplifier, the electronic device 110 should (in some embodiments)

automatically default to a volume setting that corresponds to a maximum volume around this value (or at least a high volume).

This has the advantage in that if the user has set a different (and typically lower) volume setting on the electronic device 110, it should not be necessary to adjust to the better and higher volume for automatic matching to the volume of the audio system 120. This will tend to give a better signal-to-noise (SNR) ratio and may avoid some undesired user scenarios, such as when removing the line out connection after having increased the volume on the audio system 120 and changing to radio playback (or another audio source).

In some embodiments, one or more techniques may be used to ensure that one or more of the pulse $I_P$, the response signal $I_R$ and the jack response $I_Q$ are inaudible to a human user. For example, the pulse $I_P$, the response signal $I_R$ and the jack response $I_Q$ may have frequencies and/or spectral properties selected so as to fall outside the range of audio that can normally be perceived by a human user.

In some embodiments, the pulse is made inaudible by smoothly and slowly lowering the volume of the headphone amplifier 118, possibly even setting the output transistors of the amplifier 118 in tri-state condition during the measurement. After the measurement has been made, the volume may be increased again to a suitable level.

In some embodiments, the volume should not be changed even when an audio system has been detected after a second detection pulse has been made after a charger has been identified as being connected. When this happens, the user may have already increased the volume on the audio system. Therefore, in this case the electronic device may choose to only enable a noise reduction circuit that includes a ground sense after the ground resistor Rx and not include the ground resistor Rx in the ground path.

Implementation of one or more embodiments of the concepts described herein may realize one or more advantages, some of which have already been mentioned.

The approaches described herein can be implemented without customized audio systems. Furthermore, when applied with a motor vehicle that has a customized system, the concepts described herein generally have no adverse effects. Consequently, the systems and apparatus as described herein need not be modified specifically depending upon the properties or operating characteristics of the audio system.

In addition, the concepts described herein can be implemented in an economical, compact and lightweight way, which may be beneficial for portable electronic devices in general and for handheld devices in particular (where considerations of size and weight may be particularly important).

Various embodiments may be beneficial in their adaptability to many different kinds of electronic devices, chargers and audio systems. In some embodiments, addition of space-consuming hardware or electrical pins can be avoided.

While the above description provides examples of one or more apparatus, methods, or systems, it will be appreciated that other apparatus, methods, or systems may be within the scope of the present description as interpreted by one of skill in the art.

The invention claimed is:

1. A method comprising:

at a portable electronic device comprising an audio jack that is adapted to be coupled to an audio system:

generating, at a pulse generator of the portable electronic device, a pulse on a ground return line of the audio jack of the portable electronic device;

in response to detecting, at a detector of the portable electronic device that is coupled to a charging ground line of the portable electronic device, a response signal corresponding to the pulse on the charging ground line, determining that the portable electronic device is coupled to the audio system; and absent detecting the response signal at the detector, determining that the portable electronic device is not coupled to the audio system.

2. The method of claim 1, further comprising, before generating the pulse, measuring an observed impedance at the audio jack of the portable electronic device, and generating the pulse only when the observed impedance is within a particular impedance range associated with accessories.

3. The method of claim 1, further comprising determining that the portable electronic device is coupled to a charging accessory before generating the pulse.

* * * * *